US007896077B2

(12) United States Patent
Behrmann et al.

(10) Patent No.: US 7,896,077 B2
(45) Date of Patent: Mar. 1, 2011

(54) PROVIDING DYNAMIC TRANSIENT PRESSURE CONDITIONS TO IMPROVE PERFORATION CHARACTERISTICS

(75) Inventors: Lawrence A. Behrmann, Houston, TX (US); Brenden M. Grove, Missouri City, TX (US); Raymond J. Tibbles, Kuala Lumpur (MY); Jeremy Harvey, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 547 days.

(21) Appl. No.: 11/862,297

(22) Filed: Sep. 27, 2007

(65) Prior Publication Data

US 2009/0084552 A1 Apr. 2, 2009

(51) Int. Cl.
*E21B 29/02* (2006.01)

(52) U.S. Cl. ..... 166/297; 166/55.1; 166/292

(58) Field of Classification Search ..... 166/297, 166/55.1, 187, 292; 175/4.54
See application file for complete search history.

(56) References Cited

U.S. PATENT DOCUMENTS

| | | | | | |
|---|---|---|---|---|---|
| 2,828,823 | A * | 4/1958 | Mounce | 277/331 |
| 3,517,745 | A | 6/1970 | Suman | |
| 4,120,612 | A * | 10/1978 | Brown | 417/53 |
| 4,253,523 | A | 3/1981 | Ibsen | |
| 5,063,822 | A | 11/1991 | Lopez de Cardenas | |
| 5,107,929 | A | 4/1992 | Lopez de Cardenas | |
| 5,551,514 | A | 9/1996 | Nelson et al. | |
| 5,806,593 | A * | 9/1998 | Surles | 166/270 |
| 6,069,118 | A | 5/2000 | Hinkel et al. | |
| 6,173,783 | B1 * | 1/2001 | Abbott-Brown et al. | 166/370 |
| 6,350,721 | B1 | 2/2002 | Fu et al. | |
| 6,755,249 | B2 | 6/2004 | Robison et al. | |
| 6,758,271 | B1 | 7/2004 | Smith | |
| 6,828,280 | B2 | 12/2004 | England et al. | |
| 6,837,310 | B2 * | 1/2005 | Martin | 166/297 |
| 6,874,579 | B2 * | 4/2005 | Johnson et al. | 166/298 |
| 6,959,765 | B2 * | 11/2005 | Bell | 166/297 |
| 7,036,594 | B2 * | 5/2006 | Walton et al. | 166/297 |
| 7,059,407 | B2 | 6/2006 | Tolman et al. | |
| 7,096,954 | B2 | 8/2006 | Weng et al. | |
| 7,121,340 | B2 | 10/2006 | Grove et al. | |
| 7,219,731 | B2 | 5/2007 | Sullivan et al. | |
| 7,222,676 | B2 | 5/2007 | Patel et al. | |
| 7,231,978 | B2 | 6/2007 | Rivas et al. | |
| 2005/0167108 | A1 | 8/2005 | Chang et al. | |
| 2007/0142547 | A1 | 6/2007 | Vaidya et al. | |

FOREIGN PATENT DOCUMENTS

| | | | |
|---|---|---|---|
| WO | 2004074621 | A2 | 9/2004 |
| WO | 2004074621 | A3 | 11/2004 |

* cited by examiner

*Primary Examiner*—William P Neuder
*Assistant Examiner*—Robert E Fuller
(74) *Attorney, Agent, or Firm*—Kevin B. McGoff; Rodney Warfford; Trop, Pruner & Hu

(57) ABSTRACT

A transient overbalance condition is created in a wellbore interval such that a pressure of the wellbore interval is greater than a reservoir pressure in surrounding formation. Creating the transient overbalance condition causes a near-wellbore region of the formation to increase in pressure. The pressure in the wellbore interval is reduced at a rate that produces a relative underbalance condition in which the pressure in the wellbore interval is less than the pressure of the near-wellbore region of the formation, but the pressure in the wellbore interval is greater than the reservoir pressure.

20 Claims, 4 Drawing Sheets

PROVIDING DYNAMIC TRANSIENT PRESSURE CONDITIONS TO IMPROVE PERFORATION CHARACTERISTICS

TECHNICAL FIELD

The invention relates generally to providing dynamic transient pressure conditions in a wellbore to improve characteristics of perforations formed in reservoirs.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casings and to extend perforations into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnels may impair the productivity of production wells or the injectivity of injector wells.

To obtain clean perforations and to remove perforation damage, underbalanced perforating can be performed, where the perforation is carried out with lower wellbore pressure than the formation pressure. Schlumberger's PURE (Perforating for Ultimate Reservoir Exploitation) technology has been used to provide a transient underbalance just after creating perforations to minimize or eliminate perforation damage and to enhance productivity or infectivity.

However, it has been determined that using just a transient underbalance does not provide optimal perforations in some scenarios.

SUMMARY

In general, according to an embodiment, a method for use in a well includes creating a transient overbalance condition in a wellbore interval such that a pressure of the wellbore interval is greater than a reservoir pressure in surrounding formation, where creating the transient overbalance condition causes a near-wellbore region of the formation to increase in pressure. The pressure in the wellbore interval is reduced at a rate that produces a relative underbalance condition in which the pressure in the wellbore interval is less than the pressure of the near-wellbore region of the formation, but the pressure in the wellbore interval is greater than the reservoir pressure.

In general, according to another embodiment, a method for use in a well includes generating a pressure overbalance condition in a wellbore interval using a device having an inflatable element, where the inflatable element is inflated to generate the transient pressure overbalance condition. After generation of the pressure overbalance condition, the device is used to drop the pressure in the wellbore interval to create a pressure differential between the wellbore interval and surrounding near-wellbore region of the formation.

Other or alternative features will become apparent from the following description, from the drawings, and from the claims.

DETAILED DESCRIPTION

Figure 1:
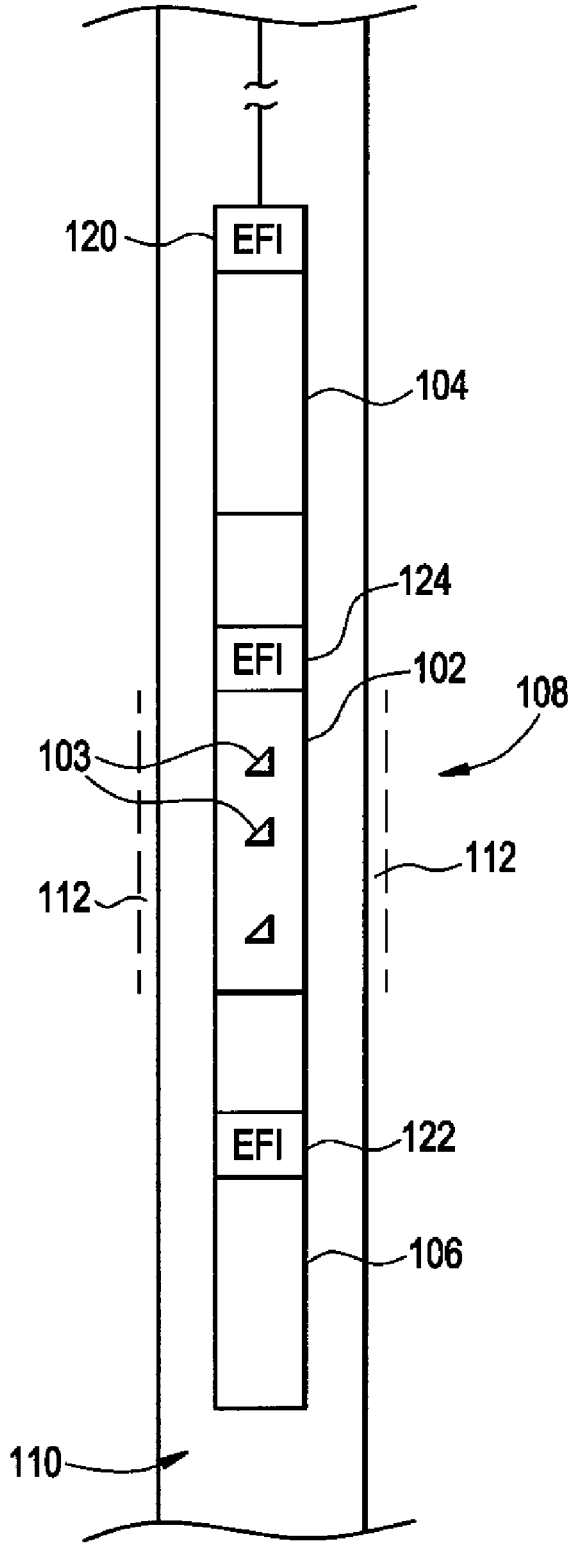
FIG. 1 illustrates an example arrangement of a portion of a tool string used to form perforations in a formation surrounding a wellbore interval, according to an embodiment.

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; or other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a transient pressure overbalance condition is generated in a wellbore interval using a dynamic overbalance chamber (DOBC) device that has an inflatable element that is inflated to generate the pressure overbalance condition. In some implementations, the transient pressure overbalance condition can be created prior to initiation of shaped charges in a perforating gun such that during formation of perforation tunnels in surrounding formation, wellbore fluid is forced into the perforations resulting in an increase in pore pressure adjacent to the perforations.

The DOBC device can also be used to create a pressure differential between the wellbore interval and the surrounding formation by deflating or abruptly halting the inflation of the inflatable element of the DOBC device. In some embodiments, deflation of the inflatable element in the DOBC device allows the pressure in the wellbore interval to drop faster than the surrounding formation pressure. As a result, there is some period of time during which the wellbore interval has a lower pressure than the surrounding formation pressure, effectively providing a relative underbalance condition in which the pressure in the wellbore interval is less than the pressure of the surrounding formation, at least in the near-wellbore region of the formation. The near-wellbore region of a formation refers to the region of the formation adjacent the wellbore. The ability to create the pressure differential between the wellbore interval and at least the near-wellbore region of the formation addresses issues in which a true underbalance condition cannot easily be created, such as when reservoir pressure is relatively low.

Effectively, a technique according to some embodiments allows for super-charging of the near-wellbore region of the formation to a higher pressure, using the DOBC device, such that the subsequent drop in the wellbore interval at a faster rate than the near-wellbore region of the formation allows for the creation of the relative underbalance condition in which the wellbore pressure is less than the pressure of the formation in the near-wellbore region. A true underbalance condition is a condition where the wellbore interval pressure is lower than the surrounding reservoir pressure. The relative underbalance condition created using the DOBC device provides an underbalance of the wellbore interval relative to the super-charged near-wellbore region—the reservoir pressure may actually be at or lower than the wellbore interval pressure.

FIG. 1 illustrates an example arrangement that shows a portion of a perforating tool that includes a perforating gun 102, a first DOBC device 104 above the perforating gun 102, and a second DOBC device 106 below the perforating gun 102. In alternative implementations, just one DOBC device (or more than two DOBC devices) can be used.

The perforating gun 102 includes shaped charges 103 that when fired creates perforating jets that extend into the formation 108 that surrounds wellbore interval 110. In the example arrangement of FIG. 1, the DOBC devices 104 and 106 are initiated prior to initiation of the perforating gun 102. In one example implementation, the DOBC devices 104, 106 can be activated simultaneously, or substantially simultaneously (within some predefined amount of time of each other that is less than the amount of time between activation of a DOBC device and activation of the perforating gun 102).

Activation of the DOBC devices 104, 106 (which inflates inflatable elements in the DOBC devices 104, 106) causes a transient overbalance pressure condition to be created in the wellbore interval 110. After a predetermined delay time, the perforating gun 102 is fired (in the presence of the transient pressure overbalance condition). The effect of the transient overbalance condition created by the DOBC devices 104, 106 is that a near-wellbore region 112 of the formation 108 is super-charged (in other words, the pressure of the near-wellbore region 112 is increased relative to the reservoir pressure). Following activation of the perforating gun 102, the pressure of the wellbore interval 110 is dropped (such as by deflating or abruptly halting inflation of the inflatable elements in the DOBC devices 104, 106) to create a pressure differential between the wellbore interval 110 and at least the near-wellbore region 112 of the surrounding formation 108. This effectively provides a dynamic underbalance condition to allow for perforations formed by the perforating gun 102 to be cleaned, and perforation damage to be removed or reduced.

In some implementations, to enhance the relative underbalance condition in the wellbore interval 110, the perforating gun 102 can be a gun that is able to create a pressure drop (in the form of a surge) after the perforating operation. In such implementations, the pressure drop can be accomplished by using a surge chamber in the perforating gun 102, where the surge chamber is initially sealed from the wellbore environment. The surge chamber can include an atmospheric chamber. Activation of the perforating gun 102 and firing of shape charges 103 in the perforating gun 102 causes one or more ports of the surge chamber to be opened such that surrounding wellbore fluids can rapidly flow into the surge chamber to create the dynamic underbalance condition in the wellbore interval 110.

In other implementations, the perforating gun 102 can be a standard perforating gun without a surge chamber. In such implementations, the DOBC devices 104, 106 are relied upon to provide the relative underbalance condition in the wellbore interval 110.

In some implementations, each of the DOBC devices 104, 106 and perforating gun 102 can be activated by using a respective initiating device 120, 122, and 124. The initiating devices 120, 122, 124 can be exploding foil initiator (EFI) devices or exploding bridge wire (EBW) devices, in which provision of an input activation voltage causes a portion (e.g., a metallic foil) to explode or vaporize, which causes a small flyer to shear from a surface and to travel in a direction towards an explosive element. The flyer, upon impact with the explosive element, causes detonation of the explosive element.

The EFI device can be a triggered EFI device, where a trigger input is provided to allow easier and more reliable activation of the EFI device.

The EFI devices 120, 122, and 124 can be associated with delay mechanisms to allow for one of the EFI devices (e.g., EFI device 124 associated with the perforating gun 102) to be delayed with respect to at least another EFI device (e.g., EFI device 120 and/or EFI device 122). The delay mechanism allows for a delay of several milliseconds, for example, between activation of the DOBC devices and the perforating gun, such that the perforating gun can be fired in the presence of the transient overbalance condition created by the DOBC devices.

Figure 2:
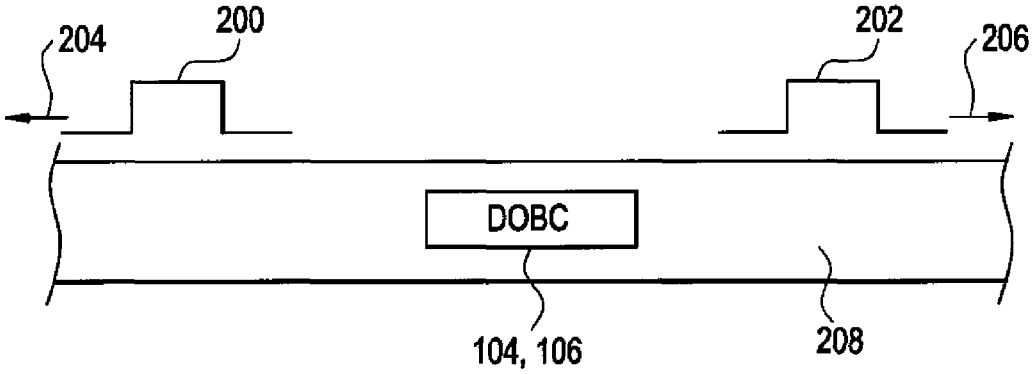
FIG. 2 illustrates generation of pressure pulses using a pressure-controlling device in the tool string of FIG. 1.

FIG. 2 illustrates how a DOBC device 104 or 106 is able to create a transient overbalance condition. Activation of the DOBC device 104 or 106 causes two pressure pulses 200 and 202 to be created, one moving in a first direction 204 along the wellbore 208, and the second pressure pulse 202 traveling in the second direction 206 that is opposite the first direction 204 along the wellbore 208. Thus, going back to the example of FIG. 1, activation of the DOBC device 106 would cause a first pressure pulse to travel upwardly, and a second pressure pulse to travel downwardly. Activation of the DOBC device 104 would also cause a first pressure pulse to travel upwardly, and a second pressure pulse to travel downwardly. In the region adjacent the perforating gun 102, the two pressure pulses (the downwardly traveling pressure pulse from DOBC device 104 and the upwardly traveling pressure pulse from the DOBC device 106) combine to generate the transient overbalance condition. Note that use of just one DOBC device (instead of two as depicted in FIG. 1) would also be sufficient to generate the transient overbalance condition.

Figure 3:
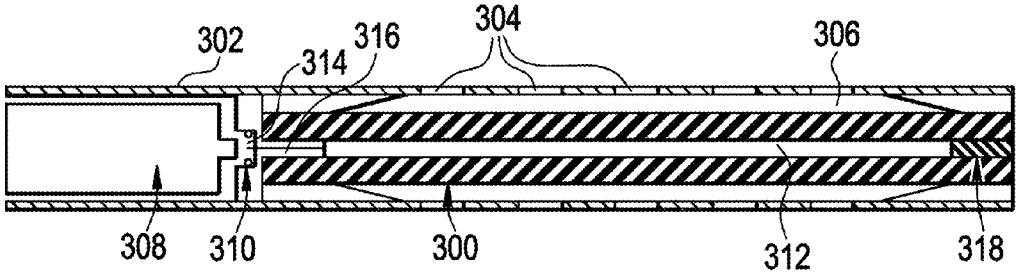
FIGS. 3-5 illustrate an example of a dynamic overbalance chamber device for generating a transient overbalance condition according to an embodiment.

An example DOBC device 104 or 106 is depicted in FIG. 3, where the DOBC device 104 or 106 includes an inflatable element 300 (which can be an inflatable bladder) contained in a housing 302 of the DOBC device. The inflatable bladder 300 can be formed of a polymer or other flexible material that allows for inflation of the bladder 300. Alternatively, the bladder 300 can be formed of a high strength textile material which can be deployed similar in manner to an automotive air bag. The housing 302 has ports 304 that allow fluid communication between an inner cavity 306 of the DOBC device and the outside of the DOBC device. These ports can be holes of controlled diameter or permeable barriers.

Another example of an inflatable element can be a moving metal boundary, such as a metallic canister containing an energetic material. This example would create a wellbore pressure overbalance condition of shorter duration but larger amplitude than the inflatable bladder example.

The DOBC device 104 or 106 also includes pressure source 308 that is positioned in the housing 302 next to the inflatable bladder 300. The pressure source 308 can be a propellant or a pressurized gas cylinder, according to some examples.

A pressure communication mechanism 310 is provided between the pressure source 308 and the inflatable bladder 300. The other end of the inflatable bladder 300 is connected to an end plug 318. The pressure communication mechanism 310, when activated, allows for pressure from the pressure source 308 to be communicated into an inner chamber 312 of the inflatable bladder 300 to cause the inflatable bladder 300 to expand radially outwardly. For example, if the pressure source 308 is a pressurized gas cylinder, then the pressure communication mechanism 310 can include a pierce valve 314 that pierces an opening in the pressurized gas cylinder 308 to allow pressure in the pressurized gas cylinder 308 to flow through the pierce valve 314 and a flow path 316 into the inner chamber 312 of the inflatable bladder 300. Piercing of the pressurized gas cylinder 308 can be accomplished by moving the pressurized gas cylinder longitudinally toward the pierce valve 314 such that a seal of the pressurized gas cylinder is broken. Alternatively, the pierce valve 314 can have a moveable piercing element that when actuated can pierce a seal of the pressurized gas cylinder, or alternatively, a seal of the inflatable bladder 300.

If the pressure source 308 is a propellant, then the pierce valve 314 can be omitted, as the propellant would be ignited to burn to cause creation of the pressurized gas that is communicated through the pressure communication mechanism 310 into the inner chamber 312 of the inflatable bladder 300.

Figure 4:
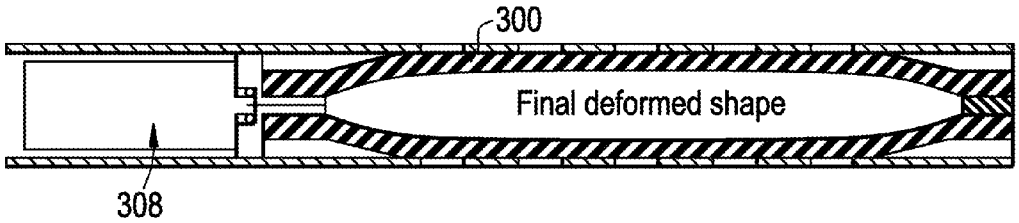

FIG. 4 shows engagement of a pressurized gas cylinder 308, which has been moved longitudinally along the longitudinal axis of the DOBC device 104, 106 to engage the pierce valve 314 such that the pressurized gas inside the pressurized gas cylinder 308 communicates through the pressure communication mechanism 310 into the inner chamber 312 of the inflatable bladder 300. As depicted in FIG. 4, the inflatable bladder 300 is in its inflated state.

Figure 5:
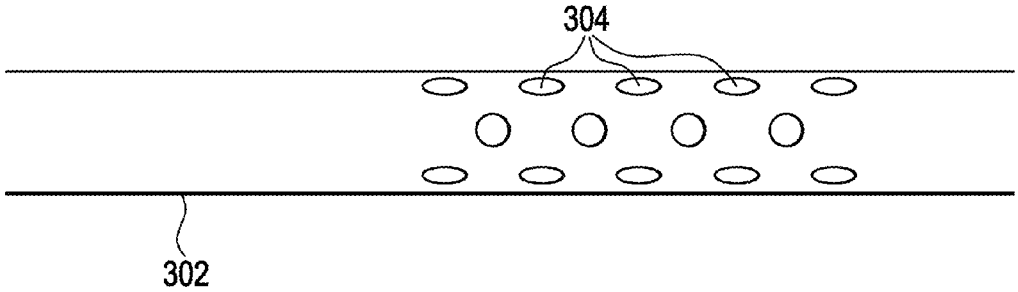

FIG. 5 is an outer view of the DOBC device that shows the external housing 302 along with the ports 304 of the housing 302.

Figure 6:
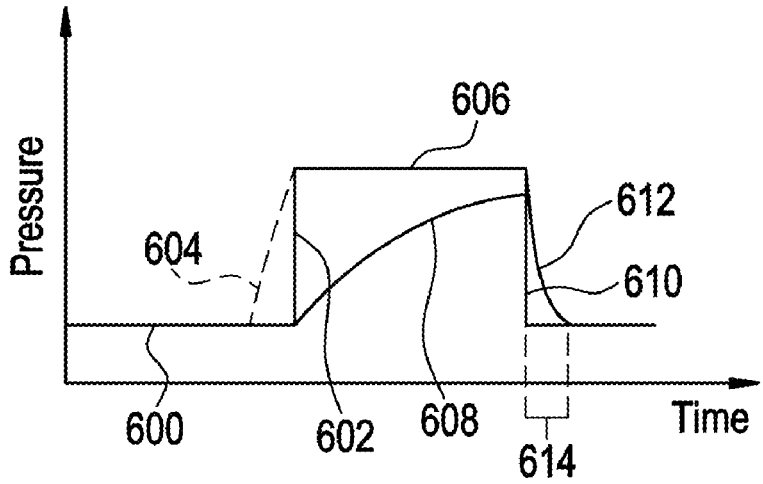
FIG. 6 is a graph depicting wellbore pressure and near-wellbore formation pressure as a function of time, generated using the tool string according to an embodiment.

FIG. 6 is a graph that shows wellbore pressure and near-wellbore pressure as a function of time, where the pressures are generated by operation of a DOBC device. The wellbore pressure is initially at a relatively low level (600), which corresponds to a time period where the DOBC device has not yet been activated. At some point, the DOBC device is activated, such as by igniting a propellant or by communicating the pressurized gas of a pressurized gas cylinder into the inner chamber of the inflatable bladder. Inflation of the inflatable bladder of the DOBC device causes the wellbore pressure to increase (as indicated at 602). Although a step 602 is illustrated to show the pressure increase, it is noted that the rise in pressure is likely to be more gradual, as indicated by the dashed ramp indicated as 604.

The wellbore pressure reaches a high level (606) which corresponds to the pulse created by the DOBC device. As further shown in FIG. 6, in response to the transient overbalance condition in the wellbore interval, the near-wellbore region of the surrounding formation is super-charged (as represented by the gradual increase in pressure represented as 608).

At some point, pressurized gas is removed from the inner chamber of the inflatable bladder, which can occur by moving the pressurized gas cylinder away from the inflatable bladder, or due to the propellant burnout. Alternatively, the inflation of the bladder can be abruptly halted. As a result, as further depicted in FIG. 6, the wellbore pressure drops relatively rapidly (as indicated by 610). The pressure drop in the near-wellbore region of the formation is more gradual, as depicted by 1612. Thus, there is some time duration (represented as 614) where the pressure in the wellbore interval is lower than the pressure of the near-wellbore region of the formation, which effectively provides a relative underbalance condition to allow perforations to be cleaned and damage in perforations to be reduced or removed.

Figure 7:
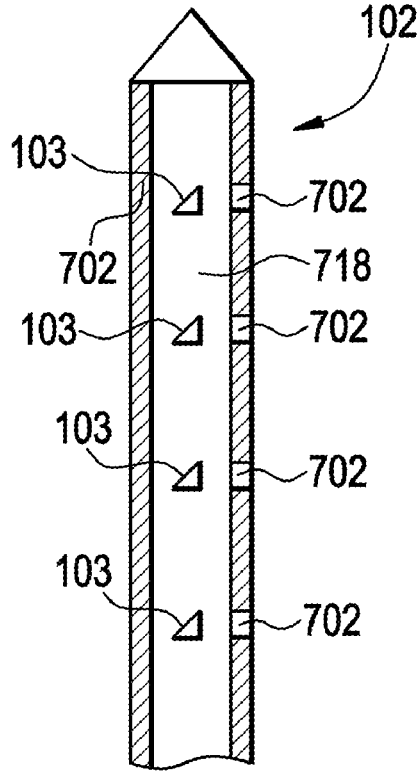
FIG. 7 illustrates a perforating gun having a surge chamber.

Referring to FIG. 7, creating an underbalance condition during a perforating a perforating gun 102 includes a gun housing 702. In one embodiment, the perforating gun 102 is a hollow carrier gun having shaped charges 103 inside a chamber 718 of the sealed housing 702.

During detonation of the shaped charges 103, perforating ports 720 are formed in the housing 702 as a result of perforating jets produced by the shaped charges 103. During detonation of the shaped charges 103, hot gas fills the internal chamber 718 of the gun 102. If the resultant detonation gas pressure is less than the wellbore pressure by a given amount, then the cooler wellbore fluids will be drawn into the chamber 718 of the gun 102. The rapid acceleration of well fluids through the perforation ports 720 will break the fluid up into droplets, which results in rapid cooling of the gas within the chamber 718. The resultant rapid gun pressure loss and even more rapid wellbore fluid drainage into the chamber 718 causes the wellbore pressure to be reduced.

In some implementations, a treating fluid can be provided in the vicinity of the perforating gun 102. The treating fluid can be provided in the wellbore interval 110, in the perforating gun 102 itself, or in some other container. The treating fluid is driven into perforations by the transient overbalance condition created by the DOBC devices.

One type of treating fluid is a consolidation fluid that can be used to strengthen the perforations and near-wellbore region of the formation to prevent formation movement or movement of fine particles. One example type of consolidation fluid includes an epoxy fluid that is embedded with micro-capsules, where the micro-capsules have inner cavities that contain a hardener or catalyst fluid. Initially the hardener fluid inside the micro-capsules is isolated from the epoxy fluid. Initially, the wellbore interval can have a modest overbalance condition with the consolidation fluid covering the wellbore interval to be perforated. The creation of a large dynamic overbalance condition by the DOBC devices results in a shock wave moving through the wellbore fluid to fracture the micro-capsules such that the hardener fluid inside the micro-capsules are mixed with the epoxy. During this time period, the large dynamic overbalance condition forces the epoxy mixture into the near-wellbore region of the formation. Hardening of the epoxy helps to consolidate weak and unconsolidated rock in the near-wellbore region. A benefit of performing consolidation as discussed above is that a one-trip screenless sand control operation is possible.

Another technique of delivering a hardener or catalyst fluid into the formations is to pre-deliver the hardener or catalyst fluid into the perforations, such as with drilling fluid used during the drilling of the wellbore.

Additionally, fluid above the DOBC device can be a post-wash fluid that is injected by application of continuous wellhead pressure. For applying the post-wash fluid, guns with big hole charges can be used. Such guns do not need to have surge chambers.

In another application, the treating fluid can be an acid, such as HCl, to treat a carbonate reservoir. The application of a large transient dynamic overbalance condition would inject a relatively large amount of acid into the perforations to provide stimulation. Perforating in the presence of the transient overbalance condition created by the DOBC device(s), with acid, enables perforating plus acidizing. Acidizing helps remove or reduce perforation damage.

Another type of treating fluid that can be used is proppant-laden fracturing fluid provided in the wellbore interval 110.

Proppant refers to particles mixed with fracturing fluid, which can be used in a fracturing operation to hold fractures open.

In another application, multiple treating fluids can be provided in the presence of the transient overbalance condition created by the DOBC device(s). Activation of the perforating gun to perform perforating can then cause the multiple treating fluids to be mixed. In some implementations, mixing of multiple fluids can cause activation of the fluids. This may be useful with resin consolidation, for example.

In another implementation, sequential application of multiple treating fluids can be performed. A first treating fluid can be applied in the presence of the transient overbalance condition created by the DOBC device(s). After waiting a predetermined delay, another transient overbalance condition can be created, such as by release of a pressurized gas (e.g., nitrogen). A second treating fluid can be applied to the wellbore interval in the presence of the second transient overbalance condition.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method for use in a well, comprising:

creating a transient overbalance condition in a wellbore interval such that a pressure of the wellbore interval is greater than a reservoir pressure in a surrounding formation, wherein creating the transient overbalance condition comprises using a first device uphole of the wellbore interval and a second device downhole of the wellbore interval, wherein activation of each of the first and second devices causes the respective one of the first and second devices to generate a pressure pulse that travels to the wellbore interval, where the pressure pulses of the first and second devices combine to create the transient overbalance condition, wherein creating the transient overbalance condition causes a near-wellbore region of the formation to increase in pressure; and after creating the transient overbalance condition, reducing the pressure in the wellbore interval at a rate that produces a relative underbalance condition in which the pressure in the wellbore interval is less than the pressure of the near-wellbore region of the formation.

2. The method of claim 1, further comprising:

firing a perforating gun after creating the transient overbalance condition, wherein reducing the pressure occurs after firing the perforating gun.

3. The method of claim 1, further comprising applying a treating fluid to the surrounding formation in presence of the transient overbalance condition.

4. The method of claim 3, wherein applying the treating fluid comprises applying a consolidation fluid to consolidate the surrounding formation.

5. The method of claim 3, further comprising:

applying at least another treating fluid; and mixing the treating fluids as part of a perforating process.

6. The method of claim 3, further comprising:

waiting a predetermined delay after creating the transient overbalance condition;

after waiting the predetermined delay, creating a second transient overbalance condition in the wellbore interval; and applying a second treating fluid in presence of the second transient overbalance condition.

7. The method of claim 3, wherein applying the treating fluid comprises applying an acid.

8. The method of claim 3, wherein applying the treating fluid comprises applying a proppant-laden fracturing fluid.

9. A method for use in a well, comprising:

creating a transient overbalance condition in a wellbore interval such that a pressure of the wellbore interval is greater than a reservoir pressure in a surrounding formation, wherein creating the transient overbalance condition causes a near-wellbore region of the formation to increase in pressure;

reducing the pressure in the wellbore interval at a rate that produces a relative underbalance condition in which the pressure in the wellbore interval is less than the pressure of the near-wellbore region of the formation; and firing a perforating gun after creating the transient overbalance condition, wherein reducing the pressure occurs after firing the perforating gun, wherein creating the transient overbalance condition and reducing the pressure in the wellbore interval are performed using a device having an inflatable element, wherein the inflatable element comprises an inflatable bladder, wherein creating the transient overbalance condition is performed by inflating the bladder, and wherein reducing the pressure in the wellbore interval is performed by deflating the inflatable bladder or abruptly halting the inflation of the bladder.

10. The method of claim 9, wherein the device having the inflatable element is activated with a first activating mechanism, and wherein the perforating gun is fired with a second activating mechanism having a delay mechanism to set a delay between activation of the device having the inflatable element and firing of the perforating gun.

11. The method of claim 10, wherein the first and second activating mechanisms comprise exploding foil initiator (EFI) or exploding bridge wire (EBW) activating mechanisms.

12. A method for use in a well, comprising:

creating a transient overbalance condition in a wellbore interval such that a pressure of the wellbore interval is greater than a reservoir pressure in a surrounding formation, wherein creating the transient overbalance condition causes a near-wellbore region of the formation to increase in pressure;

reducing the pressure in the wellbore interval at a rate that produces a relative underbalance condition in which the pressure in the wellbore interval is less than the pressure of the near-wellbore region of the formation;

applying a consolidation fluid to the surrounding formation in presence of the transient overbalance condition to consolidate the surrounding formation, wherein applying the consolidation fluid comprises:

providing epoxy fluid embedded with micro-capsules having a hardener fluid; and using a pressure wave produced by the transient overbalance condition to break the micro-capsules to mix the epoxy fluid with the hardener fluid to provide the consolidation fluid.

13. A method for use in a well, comprising:

generating a transient pressure overbalance condition in a wellbore interval using a device having an inflatable element, wherein the inflatable element is inflated to generate the transient pressure overbalance condition; and after generation of the transient pressure overbalance condition, using the device to drop a pressure in the wellbore interval to create a pressure differential between the wellbore interval and a near-wellbore region of a formation, wherein dropping the pressure in the wellbore interval is caused by deflating or abruptly halting the inflation of the inflatable element, and wherein deflating or abruptly halting the inflation of the inflatable element allows pressure in the wellbore interval to drop faster than pressure of the near-wellbore region of the formation.

14. The method of claim 13, wherein the formation has a reservoir pressure that is lower than the pressure of the near-wellbore region of the formation after the pressure of the near-wellbore region is increased by the transient pressure overbalance condition.

15. The method of claim 13, further comprising activating a perforating gun in presence of the pressure overbalance condition created by the device.

16. The method of claim 15, wherein activating the perforating gun occurs a set delay after activating the device to generate the pressure overbalance condition.

17. The method of claim 13, wherein the device further comprises a pressurized gas source that generates pressurized gas to inflate the inflatable element, the method further comprising activating the pressurized gas source to inflate the inflatable element.

18. The method of claim 17, wherein the pressurized gas source comprises a propellant, and wherein activating the pressurized gas source comprises initiating the propellant to cause the propellant to burn.

19. The method of claim 17, wherein the pressurized gas source comprises a gas cylinder, and wherein activating the pressurized gas source comprises enabling communication of pressurized gas from the gas cylinder to the inflatable element.

20. An apparatus for use in a well, comprising:

a pressure-controlling device having an inflatable element configured to generate a transient pressure overbalance condition in a wellbore interval by inflating the inflatable element; and a perforating gun configured to be activated after activation of the pressure-controlling device such that the perforating gun perforates in presence of the transient pressure overbalance condition, wherein the pressure-controlling device is configured to further, after generation of the transient pressure overbalance condition, drop the pressure in the wellbore interval by deflating or abruptly halting the inflation of the inflatable element, and wherein deflating or abruptly halting the inflation of the inflatable element is to cause pressure in the wellbore internal to drop faster than pressure of a near-wellbore region of a surrounding formation, and wherein each of the pressure-controlling device and perforating gun has an initiator device, wherein the initiator device of the perforating gun is set to activate a predefined time delay after activation of the initiator device for the pressure-controlling device.

* * * * *